US006844654B2

(12) United States Patent
Potocnik

(10) Patent No.: US 6,844,654 B2
(45) Date of Patent: Jan. 18, 2005

(54) DRUM COMMUTATOR AND METHOD FOR PRODUCING THE SAME

(75) Inventor: Joze Potocnik, Idrija (SI)

(73) Assignee: Kolektor D.O.O, Idrija (SI)

( * ) Notice: Subject to any disclaimer, the term of this patent is extended or adjusted under 35 U.S.C. 154(b) by 0 days.

(21) Appl. No.: 10/672,877

(22) Filed: Sep. 26, 2003

(65) Prior Publication Data

US 2004/0100160 A1 May 27, 2004

Related U.S. Application Data

(63) Continuation of application No. PCT/IB02/00836, filed on Mar. 20, 2002.

(30) Foreign Application Priority Data

Mar. 29, 2001 (DE) ..... 101 15 601

(51) Int. Cl.[7] ..... H01R 43/06
(52) U.S. Cl. ..... 310/236; 29/597
(58) Field of Search ..... 310/233, 235–236; 29/597

(56) References Cited

U.S. PATENT DOCUMENTS

| | | | | |
|---|---|---|---|---|
| 5,422,528 A | | 6/1995 | Prahl | |
| 5,637,944 A | | 6/1997 | Shimoyama | |
| 5,789,842 A | | 8/1998 | Steinbach et al. | |
| 5,932,949 A | * | 8/1999 | Ziegler et al. | 310/236 |
| 6,160,337 A | * | 12/2000 | Warner | 310/233 |
| 6,236,136 B1 | * | 5/2001 | Hockaday et al. | 310/233 |
| 6,242,838 B1 | | 6/2001 | Kiyose et al. | |

FOREIGN PATENT DOCUMENTS

| | | |
|---|---|---|
| DE | 31 50 505 A1 | 7/1983 |
| DE | 42 41 407 A1 | 6/1995 |
| DE | 199 03 921 A | 8/1999 |
| DE | 199 25 286 A | 12/2000 |
| DE | 101 15 601 C1 | 9/2002 |
| EP | 0 529 911 B1 | 3/1993 |
| EP | 0 935 331 A1 | 8/1999 |
| GB | 2 112 215 A | 7/1983 |
| WO | 99/57797 | 11/1999 |

* cited by examiner

*Primary Examiner*—Burton Mullins
(74) *Attorney, Agent, or Firm*—Katten Muchin Zavis Rosenman

(57) ABSTRACT

The invention relates to a drum commutator comprising a cylinder-shaped support base (1) produced from an insulating pressed material, a plurality of metal conductor segments (3) with terminal lugs (8) disposed thereon and an equal amount of carbon segments (4) that are electrically connected to the conductor segments (3). The drum commutator, adjacent to the terminal lugs (8), further comprises an annular, closed substantially regularly cylindrical surface (19) with alternating pressed material zones and metal zones, as well as a metallized inner surface of the carbon segments (4) that communicates with the support base (1). When producing such a drum commutator, the conductor segments (3) are preferably first connected to a conductor blank via bridge portions which are removed once the conductor blank has been assembled with a carbon cylinder and the support base has been injection-molded onto it.

20 Claims, 6 Drawing Sheets

DRUM COMMUTATOR AND METHOD FOR PRODUCING THE SAME

CROSS REFERENCE TO RELATED APPLICATIONS

This application is a continuation of PCT/IB02/00836, filed on Mar. 20, 2002, still pending.

FIELD OF THE INVENTION

The present invention relates to a drum commutator comprising a barrel-shaped support body made of insulating compression-molding material, a plurality of conductor segments and an equal number of carbon segments, which are joined to the conductor segments in electrically conductive relationship. The present invention also relates to a method for producing such a drum commutator.

BACKGROUND OF THE INVENTION

For certain applications in electrical machinery, especially those that depend on the current intensity to be transmitted in connection with the installation conditions, there are used drum commutators, also known as cylindrical commutators, in which the brush contact face is disposed on a regular cylinder concentric with the commutator axis. In addition to drum commutators with metal brush contact face there are known several modifications of drum commutators of the type cited in the introduction, in which the brush contact face is disposed on the carbon segments. In a first known design of this type, the carbon segments are molded around the conductor segments. Such a drum commutator as well as a method suitable for producing the same are described, for example, in EP 0529911 B1. WO 99/57797 A1 also describes an analogous drum commutator and a method suitable for producing the same, characterized in particular by the fact that the carbon segments are molded around the conductor segments. The same is true for DE 4241407 A1 and U.S. Pat. No. 5,789,842 A.

According to a fundamentally different design, a carbon shell comprising the subsequent carbon segments is made beforehand independently of the conductor segments, and only later is joined to the latter in electrically conductive relationship. A drum commutator of this design and a method suitable for producing the same are described in DE 3150505 A1. In this case a carbon shell is joined end-to-end in electrically conductive relationship to an annular conductor blank by soldering. A barrel-shaped support body of insulating compression-molding material is then injected into the interior of the corresponding unit. Finally, the carbon shell and the conductor blank are divided into individual segments by axial parting cuts.

It is not known that drum commutators according to DE 3150505 have ever been used successfully. Obviously the drum commutator known from that document is not practical, even though the design is compelling at first sight.

Drum commutators with carbon contact face, in which the carbon segments are molded and then sintered onto the conductor segments as explained hereinabove in connection with EP 0529911 B1 and the publications that are comparable in this regard, have not proved any more effective in practice. In such drum commutators, poor contact between the carbon segments and the associated conductor segments has been consistently observed. In this connection, it must be considered that drum commutators of the type in question here are subjected to extreme operating conditions. For this reason, it is required that they withstand several hundred cycles at operating temperatures of −40° C. to +110° C. without failing under all conceivable ambient conditions (especially the most diverse fuels). In the corresponding strict tests, known drum commutators of the design cited in the introduction consistently exhibit unacceptably high resistances, suggesting poor contact between the carbon segments and the conductor segments, or else they fail completely. One reason for this may be that the wires of the rotor winding, which is attached to the commutator, are routinely welded onto the conductor segments. Because of the very high temperatures occurring during this process, the metal conductor segment in question briefly expands by a not inconsiderable percentage before shrinking once again. Not only does this lead to impairment of the mechanical joint between the carbon segments and the associated conductor segments, but also the electrically conductive joint between those parts suffers commensurately, with the result that the resistance increases. This has a particularly detrimental effect, because the carbon molding compound used to produce carbon segments by molding around the conductor segments has in any case a relatively high binder content (up to 30%), thus leading to reduced conductivity.

SUMMARY OF THE INVENTION

Against the background of this prior art, the object of the present invention is to provide a practical drum commutator with carbon contact face and also a method suitable for producing the same. Such a drum commutator should be robust, have a long useful life, and satisfy stringent requirements as to the possible operating temperatures without an increase in resistance, in particular even if it has compact dimensions. Furthermore, it should be possible to weld the wires of the rotor winding onto the conductor segments without the danger of damage.

A first substantial feature of the present invention is therefore the fact that the carbon shell from which the individual carbon segments are obtained by parting cuts in a later process step is metallized where it is joined together with the conductor blank, at least in the region of the radial inside face and one axial end face, the metallized radial inside face of the carbon shell being covered with compression-molding material during injection molding of the support body onto the composite part comprising the conductor blank and the carbon shell. Such metallization of at least one axial end face—in a manner known in itself (see DE 3150505 A1)—is intended to ensure that the electrically conductive joint between the carbon segments and the conductor segments can be made by soldering or other known joining method. Besides the method of subsequent metallization known in itself, a method known as "two-component compression molding", in which a carbon shell with already metallized end face is produced, is also suitable for production of a carbon shell with a metallized end face. For this purpose, carbon powder and an end-face layer of metal powder (such as Ag, brass, Cu) are pressed together in a mold and then sintered. Depending on the dimensions of the commutator, the thickness of the metal layer can be, for example, 1 to 2 mm. This version is suitable in particular for drum commutators operated under dry conditions; because there is no need for subsequent metallization, its costs are favorable. In contrast, the metallization of the radial inside face of the carbon shell that will subsequently bear against the support body has an advantageous effect in two completely different respects. Firstly, the ohmic resistance present in the carbon segments can be significantly reduced in this way, especially in drum commutators of elongated construction, in which the axial length is relatively large compared with the diameter. In this case the current flow between the contact zones of the carbon segments and the brushes bearing against the brush contact faces takes place largely in the region of the metallized inner surface of the carbon segments, or in other words in the radially inner regions belonging to the carbon segments and adjoining the support body. Secondly, the metallization of the radial inside face of the carbon shell leads to increased strength in this region. In particular, the metallized inner surface effectively protects the carbon shell from damage in this region. The increased strength of the carbon shell achieved in this way, and of the carbon segments subsequently obtained from this shell, permits the carbon shell to be produced with a relatively small binder content (about 2 to 5%), again resulting in a particularly favorable effect on the conductivity of the carbon segments. Because of the inventive metallization of the radial inside face belonging to the carbon shell and bearing on the support body, the ohmic resistance of the commutator can be drastically reduced both directly and indirectly compared with known designs.

According to a second substantial feature of the present invention, the finished drum commutator is provided, adjacent to the terminal lugs of the conductor segments, with an annular, closed, substantially regular cylindrical surface, which is formed by an alternating sequence of zones of compression-molding material, which are allocated to the support body, and of metal, which are allocated to the conductor segments. In contrast with the situation for the drum commutator according to DE 3150505 A1, therefore, no axially oriented incisions, axial slots or other recesses, which according to that prior art are indispensable for dividing the conductor blank into the individual conductor segments, are provided in the region adjacent to the terminal lugs in the inventive drum commutator. The absence of such recesses has the effect that the terminal region of the commutator disposed adjacent to the terminal lugs can be isolated reliably from the commutation region by means of an effective lacquer barrier. In this way, lacquer used as a protective coating on the rotor winding belonging to the corresponding electrical machine and subsequently connected to the commutator is effectively prevented from migrating into the commutation region and impairing the function of the commutator therein. A corresponding result is achieved in rotors with encapsulated winding, in which plastic is injected all around the winding together with the terminals on the commutator. In the production of such rotors, the injection-molding die used for injecting the encapsulation bears in tight sealing relationship against the annular, closed, substantially regular cylindrical surface, so that penetration of plastic into the commutation region is safely prevented. As a result, there is obtained a practical drum commutator having a carbon contact face and satisfying the existing requirements.

As regards the production of the inventive drum commutator, both the treatment of the carbon shell and the geometry of the conductor blank must be specially emphasized. Each two adjacent conductor segments of the conductor blank are joined to one another via a respective bridge part, the distance from the radial inside faces of the bridge parts to the commutator axis corresponding substantially to the distance from the radial outside faces of the conductor segments to the commutator axis. The bridge parts, which join the conductor segments of the conductor blank to one another, are radially offset toward the outside, or in other words are offset relative to the conductor segments. By the fact that the radial inside faces of the bridge parts are disposed substantially at the same radius of the commutator axis as the radial outside faces of the conductor segments, the radial extent of the ribs of compression-molding material belonging to the support body and formed between each two neighboring conductor segments corresponds substantially to the radial extent of the conductor segments. This in turn permits the annular, closed, substantially regular cylindrical surface disposed adjacent to the terminal lugs to be produced with alternating zones of compression-molding material and metal by simple removal of the bridge parts after the support body has been injection molded onto the composite part comprising the conductor blank and the annular carbon shell. These bridge parts can then be machined off with the lathe and/or knocked or sheared off in axial direction. The expense associated with this step is small; and the resulting material removal is limited to a minimum. The incisions used for dividing the carbon shell into the individual carbon segments run out close to the end face belonging to the carbon shell and facing the conductor segments, and so the annular, closed, substantially regular cylindrical surface (which at first is broader) remains largely or at least partly preserved, with alternating zones of compression-molding material and metal.

The treatment of the carbon shell by metallization of the radial inside face has already been discussed in detail hereinabove. The thickness of the metallization depends specifically on the dimensioning of the commutator. In general, however, it can be stated that the metallization is applied as a relatively thick layer, in view of its double function explained in the foregoing. Depending on the dimensioning of the commutator, it may be favorable for the metallization to penetrate to depths of between 10 $\mu$m and 200 $\mu$m into the surface of the carbon shell.

A particularly preferred improvement of the inventive method is characterized in that the carbon shell is metallized, especially by galvanization, over its entire surface, or in other words on both axial end faces, on the radial inside face and also on the radial outside face, before being joined together with the conductor blank. Hereby the carbon shell is effectively protected from damage throughout the further production process. In a subsequent process step, the metallized surface is then stripped in the region of the radial outside face forming the subsequent brush contact face, for example by means of the lathe. The metallized surface is also stripped in the region of the two end faces of the carbon shell, preferably in a radially outer annular region. In this case the metallization remains only in the region of those faces of the carbon shell or of the carbon segments subsequently obtained therefrom that are in contact either with the compression-molding material of the support body or—via the electrically conductive joint—with the conductor segments.

At this place it must be pointed out that the inventive drum commutator explained in the foregoing is indeed provided with the annular, closed, substantially regular cylindrical surface adjacent to the terminal lugs, but not in the commutation region. Instead, the carbon segments in the region of the brush contact face are isolated from one another by air gaps, which are the result of the parting cuts that divide the carbon shell into the individual carbon segments. In a particularly preferred embodiment, these air gaps are bounded only by compression-molding material of the body of compression-molding material on the one hand and by the cut faces of the carbon segments on the other hand. In other words, in this particularly preferred embodiment, the parting cuts that divide the carbon shell into the individual carbon segments extend exclusively in carbon and compression-molding material, but not in metal of the conductor blank or of the conductor segments. In this case, no exposed metal is present in the air gaps. Instead, the conductor segments are completely embedded in compression-molding material in the circumferential direction. The zones of compression-molding material of the annular, closed face explained in the foregoing are therefore broader in circumferential direction than the air gaps in this improvement of the invention.

The conductor blank used expediently to produce the foregoing commutator comprises, as explained in the foregoing, a plurality of conductor segments, wherein each two adjacent to one another are joined to one another by means of one bridge part. The bridge parts are joined along their edges to the conductor segments. They impart dimensional stability to the conductor blank during the process of production of the drum commutator, in that they maintain the predetermined arrangement and orientation of the conductor segments relative to one another until the support body has been molded on by injection. In a particularly preferred embodiment, the bridge parts extend over the entire axial length of the conductor segments. Because of this arrangement and dimensioning of the bridge parts, annularly closed faces disposed preferably in respective planes oriented perpendicular to the axis are obtained at both end faces of the tubular conductor blank. The carbon shell with associated end face can be made to bear sealingly against one of these annularly closed faces. And the other annularly closed face of the conductor blank is eminently suitable as the sealing face for the associated half of an injection-molding die, which is used for injection molding the support body of compression-molding material. The tubular conductor blank, which is circumferentially closed by the conductor segments and the bridge parts, thus tightly seals off the space to be filled with compression-molding material in cooperation with the carbon shell and the two halves of the injection-molding die.

The tubular geometry of the conductor blank also ensures that the two halves of the injection-molding die are disposed exactly opposite one another in the region of their respective sealing face with the conductor blank and carbon shell. This is particularly favorable in view of the large closing forces, which are then absorbed by the conductor blank and the carbon shell without unacceptably large stresses and possibly deformations. The closing forces cause substantially compressive stresses alone in the tubular conductor blank and the carbon shell.

In the relationship explained hereinabove—especially with regard to the sealing faces—between the unit formed by joining the conductor blank together with the carbon shell and the injection-molding die, the possibility is not ruled out that the particular injection-molding die half that bears sealingly against the free end face of the carbon shell can also bear against the conductor blank, if this projects radially beyond the carbon shell. In particular, the half in question of the injection-molding die can bear against the end faces of the bridge parts and, during closing of the injection-molding die, can contribute to specified compression of the conductor blank in axial direction.

Preferably the wall thickness of the bridge parts adjacent to the conductor segments and explained in the foregoing is considerably smaller than between each two conductor segments. This is sufficient to ensure dimensional stability of the conductor blank and to withstand the pressure exerted during injection molding of the support body of compression-molding material. The small wall thickness of the bridge parts at their two end regions facilitates subsequent removal of the bridge parts after the support body has been molded.

The arrangement and dimensioning of the bridge parts explained hereinabove ensures that they can be removed by shearing or knocking off in axial direction. This is important in particular if the bridge parts, as explained in the foregoing, extend over the entire axial length of the conductor segments in order to form a tubular conductor blank, and if the terminal lugs protrude radially from the conductor segments, since naturally it is not possible to machine off the bridge parts with the lathe between terminal lugs protruding radially in this way.

A preferred improvement of the inventive drum commutator is characterized in that the conductor segments are each provided with a thick-walled terminal region having a terminal lug, a thick-walled contact region that contacts the associated carbon segment, and a thin-walled transition region disposed between the terminal region and the contact region. In other words, it is therefore of substantial importance for the improved drum commutator of this configuration that the conductor segments are not formed with more or less the same wall thickness all over, but instead the wall thicknesses of different regions of the conductor segments differ significantly from one another, specifically by the fact that a relatively thin-walled transition region is provided between the terminal region used to connect the rotor winding and the contact region via which the electrically conductive joint is made between the conductor segment and the associated carbon segment. In this sense the wall thickness—measured perpendicular to the direction of heat flow from the terminal lugs to the contact zones—of the transition region is smaller than the wall thickness—measured in radial direction—of the terminal region and the wall thickness—generally measured in axial direction—of the contact region of the conductor segment in question. Furthermore, the terminal region also has relatively large dimensions in axial and circumferential direction (see below). Such a geometry of the conductor segments is favorable in the respect that welding of the winding wires to the terminal regions of the conductor segments will not lead to overheating-induced damage to the electrically conductive joints between the conductor segments and the carbon segments, even in extremely compact drum commutators of the smallest dimensions. This is so because the thick-walled terminal regions of the conductor segments have sufficiently large heat capacity to form a first heat sink for the heat developed during the welding process. In contrast, because of its small cross-sectional area—oriented normal to the heat flow—the thin-walled transition region from the terminal region to the contact region forms a considerable resistance to conduction of heat from the terminal region to the contact region of the conductor segment. And the thick-walled contact region in turn forms an excellent heat sink for the thermal energy (which in any case is reduced) conducted through the transition region. As a result, the heating of the contact region of the conductor segments is kept at a particularly low level during welding of the wires of the rotor winding to the conductor segments. During application of this improvement of the present invention, the risk that the electrically conductive joints between the carbon segments and the conductor segments will become damaged during welding of the rotor winding to the drum commutator is minimal, even if conventional welding techniques are used. Even soft solder can be used for a reliable and durable electrical joint between the carbon segments and the conductor segments, since the temperatures developed at the contact point are reliably below the softening point for soft solder. This is true even for extremely compact drum commutators.

As clarification, it is pointed out that the statement that the transition portion must be "thin-walled" is not to be construed as a restriction wherein the terminal region is connected to the contact region via a wall part. Instead, by the expression "thin-walled", it is to be understood that the cross section available for heat conduction, extending perpendicular to the heat-flow direction, and disposed between the terminal region and the contact region, is smaller than in the terminal region or in the contact region. In this respect, a cross-sectional constriction also forms a "thin-walled" transition region within the meaning of the present invention, as will become evident in detail hereinafter, especially from the description of a preferred practical example.

The metallization of the carbon shell in the region of the radial inside face, provided according to the present invention and explained in the foregoing, allows current to flow through large cross sections into the non-metallized regions of the carbon segments. Compared with such designs in which current flow into the carbon segments takes place exclusively in the region of their electrically conductive joint with the conductor segments, this opens up the possibility of making those regions of the electrically conductive joint between the conductor segments and the carbon segments relatively small and disposing them at a position that is optimal from the viewpoint of production process and heat control. Such a reduced extent of the area of the electrically conductive joint between the conductor segments and the carbon segments reduces the detrimental effects of thermal expansion and subsequent shrinkage of the conductor segments during welding of the rotor winding. To this extent, positive effects are in turn achieved in terms of the durability of that electrically conductive joint and the operating safety of the drum commutator.

Within the meaning explained hereinabove, the electrically conductive joints between the conductor segments and the carbon segments are disposed as far away as possible from the terminal lugs in the region of the radially inner portions of the conductor segments. In particular, the respective electrically conductive joint can then be limited to the region of the oppositely disposed anchor portions belonging to the conductor segments and carbon segments and bearing against one another (see below).

The thin-walled transition region provided between the terminal region and the contact region of each conductor segment according to the improvement of the invention explained in the foregoing has another advantageous effect in addition to its heat-conducting behavior and its resistance to heat conduction (see hereinabove). What must also be emphasized is the axial compliance or compressibility—during production of the drum commutator—of the conductor segments imparted by the thin-walled transition regions. Such compressibility (for example, by up to 2%) is favorable in regard to reliable sealing of the injection-molding die used for injection molding of the support body. In addition, manufacturing tolerances can be compensated for hereby. In this way the commutator can be made exactly to its theoretical size in the injection-molding die, regardless of tolerances that are unavoidable for economic production of the carbon shell and of the conductor blank. The effective limitation of the pressure acting on the carbon shell reduces the danger of damage to the carbon shell during production of the drum commutator, and in this way contributes to reduction of scrap. The present invention also ensures that the carbon segments comprise relatively compliant, plastic-bonded carbon; this has a particularly favorable effect on the useful life of the commutator.

According to a further preferred improvement of the invention—which has already been mentioned briefly hereinabove—the transition regions of the conductor segments are connected to the contact regions of the conductor segments at a point distant from the carbon segments. In this way a gap filled with a layer of compression-molding material is formed in each case between the terminal regions and if necessary the transition regions of the conductor segments on the one hand and the carbon segments on the other. The connection of the transition regions to the contact regions at a point distant from the respective contact zone between the conductor segment in question and the associated carbon segment is manifested once again in reduced heat transfer from the terminal regions of the conductor segments to the carbon segments. Beyond this, the layer of compression-molding material has the effect of improved protection of the electrically conductive joints between the contact regions of the conductor segments and the carbon segments against aggressive media, as well as protection against direct overheating of the carbon shell during welding of the rotor winding to the conductor segments.

Within the scope of the improvement of the invention explained in the foregoing, several geometries are possible as regards the orientation of the transition regions. From heat control viewpoints, the transition regions can be oriented radially in particular but also axially, and arbitrary diagonal intermediate values are also conceivable.

As regards the preferably provided, different wall thicknesses of the conductor segments in their different regions as explained hereinabove, a particularly favorable method of producing a conductor blank for use in production of the inventive drum commutator is a combined compression-molding and stamping process. In the first step, a bowl-shaped base body already characterized by thick-walled terminal regions, thin-walled transition regions and thick-walled contact regions is produced by compression molding. At the same time, the contact regions and if necessary the transition regions are also joined to one another by formation of a closed ring. The bottom of the base body is then segmented by stamping.

The ideal dimensions of the individual regions of the conductor segments, especially the different wall thicknesses and their ratios relative to one another, depend on different influencing variables. Nevertheless, in the case that the cross-sectional area of the transition regions of the conductor segments oriented perpendicular to the direction of heat flow is less than 80% of the cross-sectional area—also oriented perpendicular to the direction of heat flow—of the contact regions, the electrically conductive joints between the carbon segments and the conductor segments already exhibit a significantly long useful life. In a particularly preferred embodiment, the cross-sectional difference is even larger, by the fact that the cross section of the transition regions of the conductor segments amounts to less than 60% of the cross section of the contact regions. As a result, the distance from the transition regions of the conductor segments to the carbon segments is increased, provided transition regions of flat geometry are connected to the contact regions of the conductor segments at points distant from the carbon segments.

Another preferred improvement of the invention is characterized in that the terminal lugs are chamfered at the end. Such chamfering, facing the outer circumferential face of the associated conductor segments, leads to a reduction of the contact area between the terminal lugs bent over against the conductor segments and the conductor segments close to the joint with the carbon segments. This is again favorable in regard to the minimum possible transfer, to the electrically conductive joints in the region of the contact zones between the conductor segments and the carbon segments, of heat developed during welding of the wires of the rotor winding to the conductor segments.

For the metallization of the carbon shell provided according to the present invention, galvanic methods known in themselves are suitable. In this case, the carbon shell is expediently metallized over its entire surface (see hereinabove). Conceivably, however, the metallization of the carbon shell can also be achieved by high-pressure compaction of metal particles, especially of Cu powder—which if necessary is silver-coated—or Ag powder, followed by sintering.

As regards an embodiment of the inventive drum commutator that is particularly reliable and has a long useful life, the carbon segments and conductor segments thereof are anchored in the support body, particularly preferably by anchor portions that extend radially inward and are embedded therein with formation of undercuts. The anchor portions of the carbon segments on the one hand and of the conductor segments on the other are not required in any case to have the same cross section. In fact, it is particularly favorable when the anchor portions of the conductor segments have a slightly smaller cross section than the anchor portions of the carbon segments.

Because of the metallization of the carbon shell on its radial inside face as explained in the foregoing, the anchor portions of the carbon segments exhibit a metal jacket which, in the case of metallization of both end faces of the carbon shell, even completely surround the anchor portions.

In a particularly favorable embodiment, the anchor portions of the carbon segments extend over the entire axial length. In contrast, the anchor portions of the conductor segments can be limited to the region adjacent to the contact zones. The anchoring of the conductor segments in the support body can be optimized by further claws provided on the conductor segments. In this case, especially the anchor portions of the conductor segments can merge into claws having substantially axial orientation. Further retaining claws are preferably provided inside at the end face of the conductor blank adjacent to the conductor segments and disposed opposite the contact zone.

From the foregoing explanations of the present invention, it is evident that it provides a drum commutator having characteristics that have been unknown heretofore. In particular, despite low manufacturing costs, the inventive drum commutator is characterized by outstanding quality, due in particular to the high stability, and particularly small dimensions are possible. In addition, the design of the injection-molding die can be particularly simplified. Furthermore, the conductor blank can have a continuous contour inside and outside, so that it can be placed in a female die.

BRIEF DESCRIPTION OF THE DRAWINGS

The present invention will be explained in more detail hereinafter on the basis of two preferred practical examples illustrated in the drawing, wherein.

DETAILED DESCRIPTION OF THE INVENTION

Figure 2:
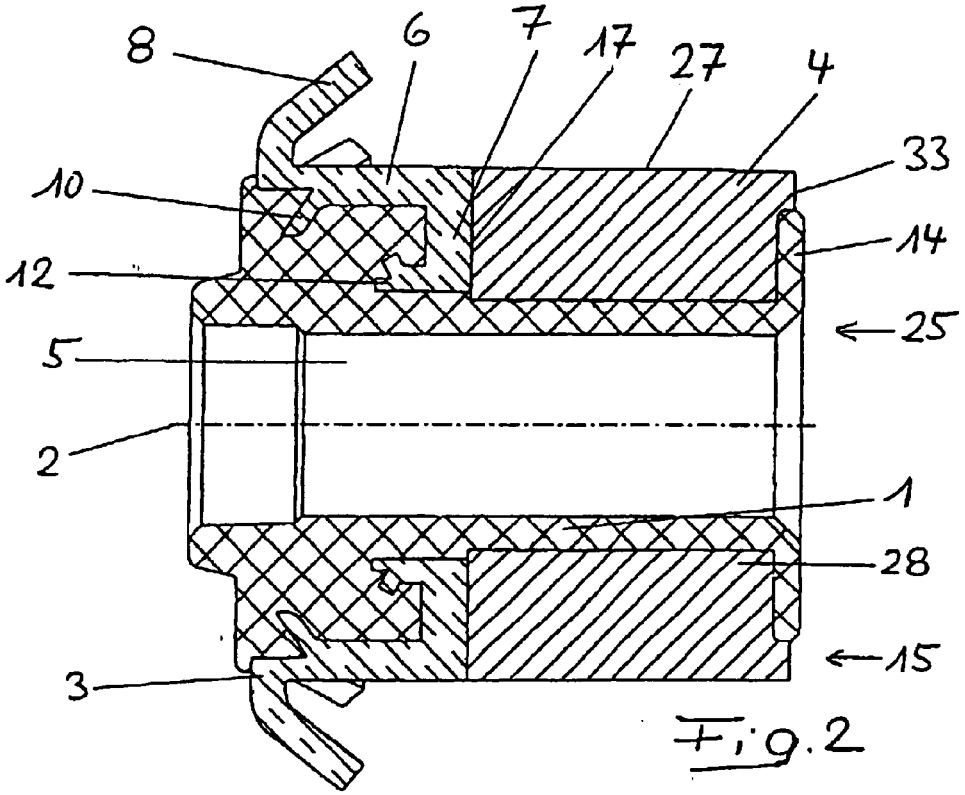
FIG. 2 shows a longitudinal section through the drum commutator according to FIG. 1.
Figure 1:
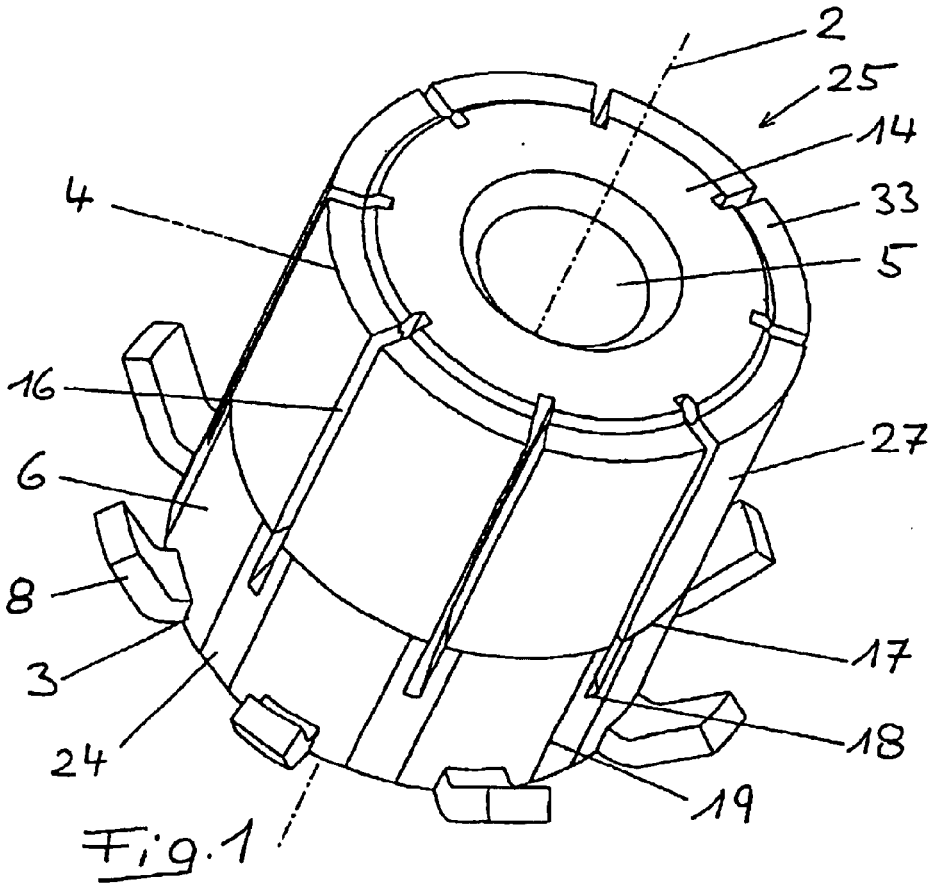
FIG. 1 shows a perspective view of a first preferred embodiment of a drum commutator according to the present invention.

The drum commutator illustrated in FIGS. 1 and 2 comprises a support body 1 made from insulating compression-molding material, eight metal conductor segments 3 disposed in uniform distribution around the axis 2, and eight carbon segments 4, each of which is joined in electrically conductive relationship to one conductor segment 3. Support body 1 is provided with a central bore 5. In this scope, the drum commutator according to FIGS. 1 and 2 corresponds to the prior art according to DE 3150505 A1, and so the basic construction need not be explained in more detail.

As will be explained in detail hereinafter, conductor segments 3 made of copper are obtained from the conductor blank illustrated in FIGS. 3 and 4. They comprise two main regions, namely terminal region 6 and contact region 7. On each of the terminal regions 6 there is disposed a terminal lug 8. This functions as the electrically conductive connection of a winding wire to conductor segment 3 in question. Terminal lugs may be provided at the end with a chamfer, specifically on that face which points radially inward in the finished drum commutator and is adjacent to associated terminal region 6 of conductor segment 3 in question.

For better anchoring of conductor segments 3 in support body 1, a retaining claw 10 projects obliquely inward from terminal regions 6 of each conductor segment 3. The radially inner ends of contact regions 7 of conductor segments 3 are formed as anchor portions 11 for the same purpose. In the finished drum commutator, anchor portions 11 are embedded in the compression-molding compound of support body 1; they extend in the direction of commutator axis 2, thus forming an undercut of anchor portions 11 in support body 1. Anchor portions 11 merge into further bifurcated retaining claws 12.

Contact regions 7 of conductor segments 3 bear with their full surface area against contact faces 13 at the end faces of carbon segments 4. In the region of the contact zones defined in this way, carbon segments 4 are joined in electrically conductive relationship to the associated conductor segments 3 by soldering.

Support body 1 contains a shoulder 14, which covers free end faces 15 of carbon segments 4 in a radially inner region and projects for a short axial distance beyond the carbon segments. To receive shoulder 14 of support body 1, free end faces 15 of the carbon segments have stepped structure.

Also illustrated are axial cuts 16, with which the originally one-piece carbon shell (see FIGS. 5 and 6) was divided into individual carbon segments 4 during production of the plane commutator. Axial cuts 16 extend in radial direction into support body 1, so that the originally one-piece carbon shell is divided into eight carbon segments that are reliably insulated from one another. In axial direction, the axial cuts do not extend over the entire axial length of the drum commutator. Instead, axial cuts 16 run out adjacent to contact zone 17, in which carbon segments 4 and conductor segments 3 are joined to one another. Hereby an annular, closed, regular cylindrical surface 19 with alternating zones of compression-molding material of support body 1 and metal of conductor segments 3 is formed in the region between the runout 18 of axial cuts 16 and terminal lugs 8.

Figure 4:
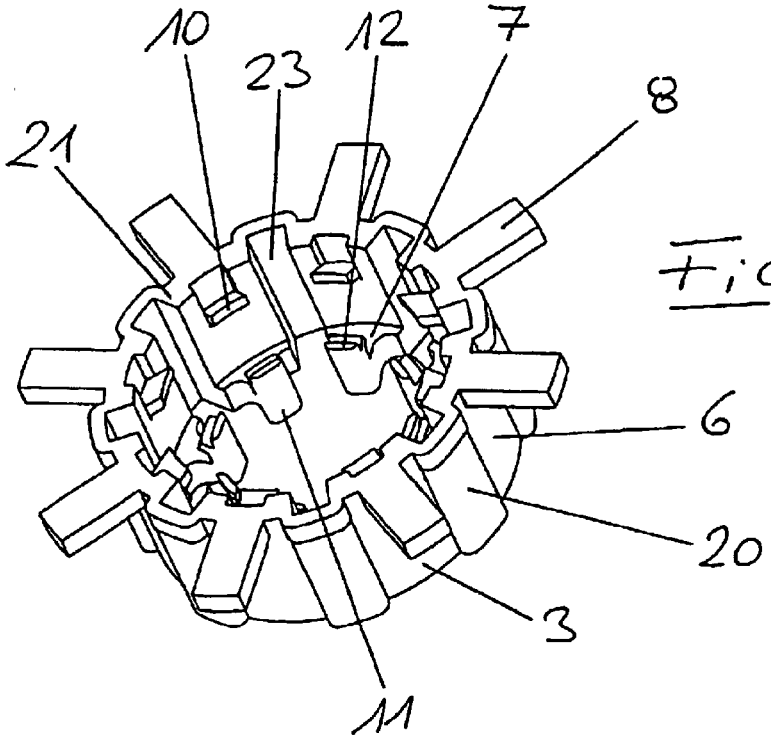
FIG. 4 shows another view of the conductor blank according to FIG. 3.
Figure 3:
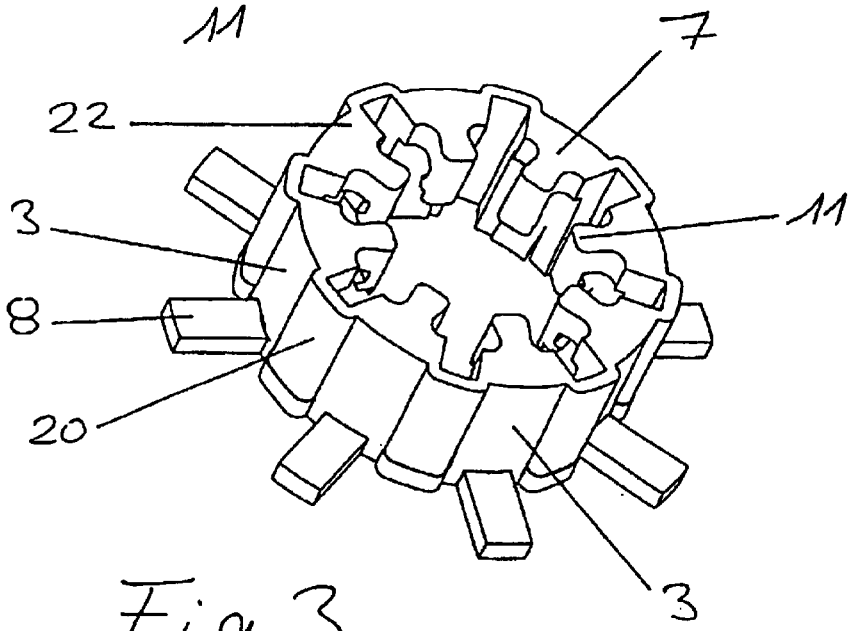
FIG. 3 shows a perspective view of the conductor blank used to produce the drum commutator according to FIG. 1.

FIGS. 3 and 4 illustrate two different perspective views of the conductor blank used to produce the drum commutator according to FIGS. 1 and 2. Many details of the conductor blank are directly evident from the foregoing explanation of FIGS. 1 and 2; to this extent reference is made to the foregoing explanations. One important feature of the conductor blank is its completely closed tubular geometry at the circumference. Between each two terminal regions 6 there is disposed a bridge part 20. Bridge parts 20 and terminal regions 6 of conductor segments 3 have the same axial extent and are joined to one another along their entire axial extent. Hereby closed annular faces 21 and 22, which are composed of the end faces of conductor segments 3 and of bridge parts 20 in alternating sequence, are formed on both end faces of the conductor blank. As explained in the foregoing, this is particularly advantageous for tight sealing of the compression mold on the one hand and of the carbon shell on the other hand to the conductor blank, and it ensures that the high closing forces necessary in view of the extremely high injection pressures do not lead to destructive deformation of the conductor blank.

The joints between bridge parts 20 and conductor segments 3 are—by appropriate dimensioning of the slots 23—of relatively thin-walled structure. This ensures that bridge parts 20 can be removed entirely or at least partly by knocking or shearing in axial direction in a single working operation after support body 1 has been molded on by injection. For this purpose it is also provided that the distance from the radially inner circumferential faces of bridge parts 20 to commutator axis 2 corresponds substantially to the distance from the radially outer circumferential faces of terminal regions 6 of conductor segments 3 to commutator axis 2. During injection molding of support body 1, slots 23 are filled with compression-molding material, thus forming corresponding ribs 24 of compression-molding material. These ribs 24 of compression-molding material are exposed by subsequent removal of bridge parts 20 (see hereinabove). Together with the radial outside faces of conductor segments 3, the radial outside faces of ribs 24 of compression-molding material form the annular, closed, regular cylindrical region of alternating zones of compression-molding material and metal, as explained in detail in the foregoing.

Figure 6:
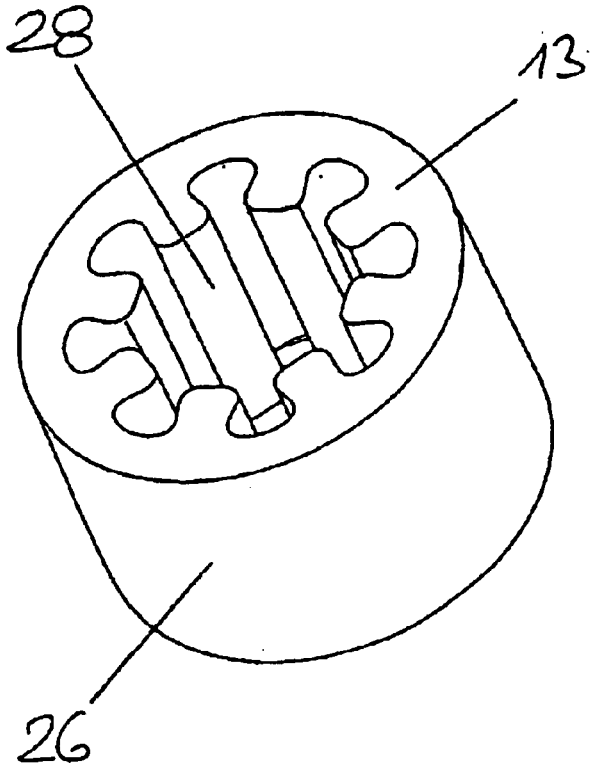
FIG. 6 shows another view of the carbon shell according to FIG. 5.
Figure 5:
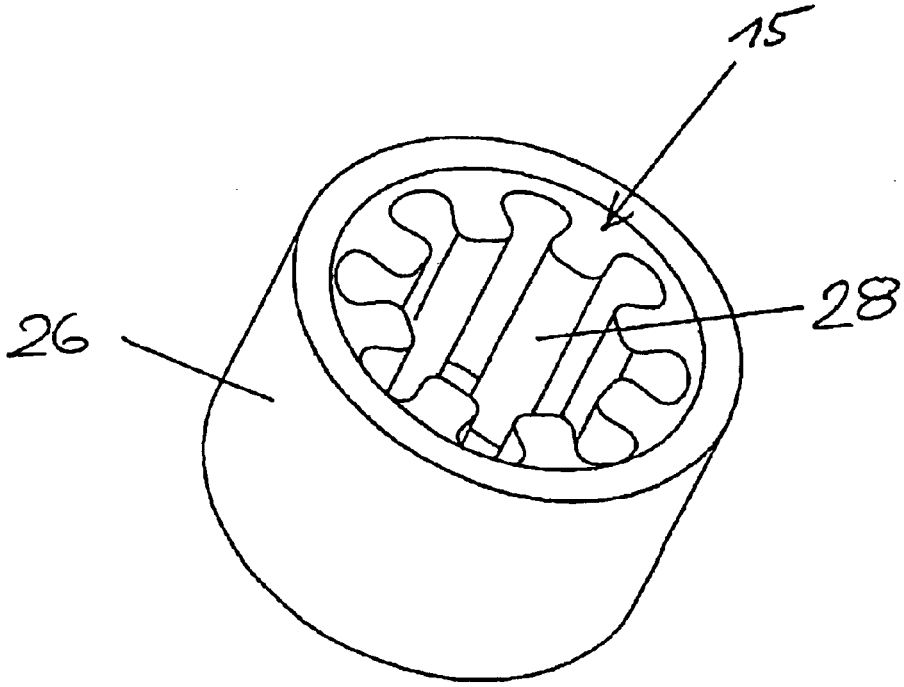
FIG. 5 shows a perspective view of the carbon shell used to produce the drum commutator according to FIG. 1.
Figure 8:
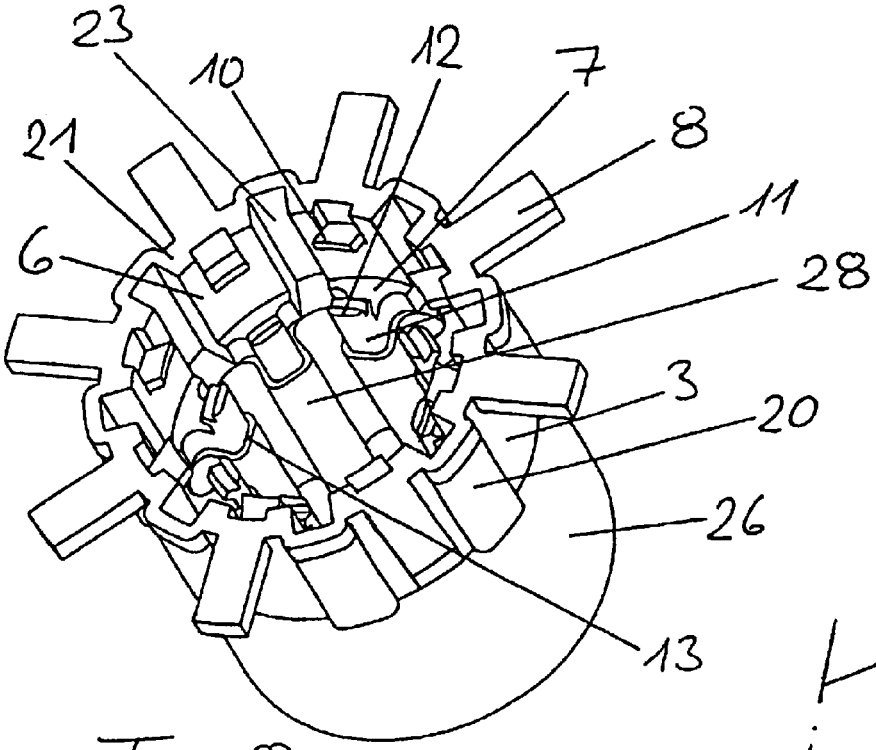
FIG. 8 shows another view of the unit according to FIG. 7.
Figure 7:
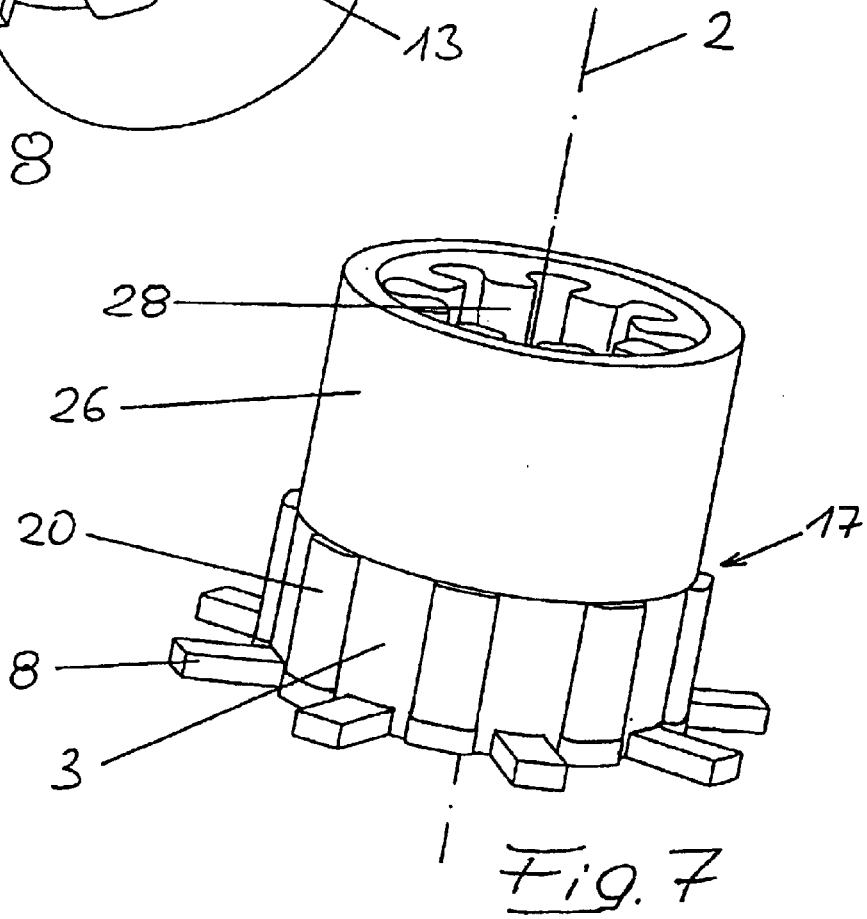
FIG. 7 shows a perspective view of the unit formed from the conductor blank according to FIGS. 3 and 4 and, soldered end-to-end thereon, the carbon shell according to FIGS. 5 and 6.

Substantial details of the carbon shell illustrated in FIGS. 5 and 6 can also be inferred already from the explanations of the finished drum commutator shown in FIGS. 1 and 2. To this extent, reference is made to the corresponding explanations. Readily evident in FIG. 5 is the stepped structure of that end face of the carbon shell which forms free end face 25 in the finished drum commutator. In contrast, as shown in FIG. 6, the opposite end face of the carbon shell has plane structure. This is the end face to which the conductor blank will be soldered. Circumferential face 26 of the carbon shell forms the subsequent brush contact face 27 of the finished drum commutator.

The inner circumferential face of the carbon shell has toothed structure, due to the fact that anchor portions 28 protrude radially inward here. Anchor portions 28 extend over the entire axial length of the carbon shell. In the finished drum commutator, anchor portions 28 are embedded in the compression-molding compound of support body 1; they extend in the direction of commutator axis 2, thus forming an undercut of anchor portions 28 in support body 1.

Before the carbon shell illustrated in FIGS. 5 and 6 is joined to the conductor blank, it is metallized both on the end face facing the said conductor blank and on the inner circumferential face, for example by pressing metal powder into the surface and then sintering, or by galvanization.

Figure 10:
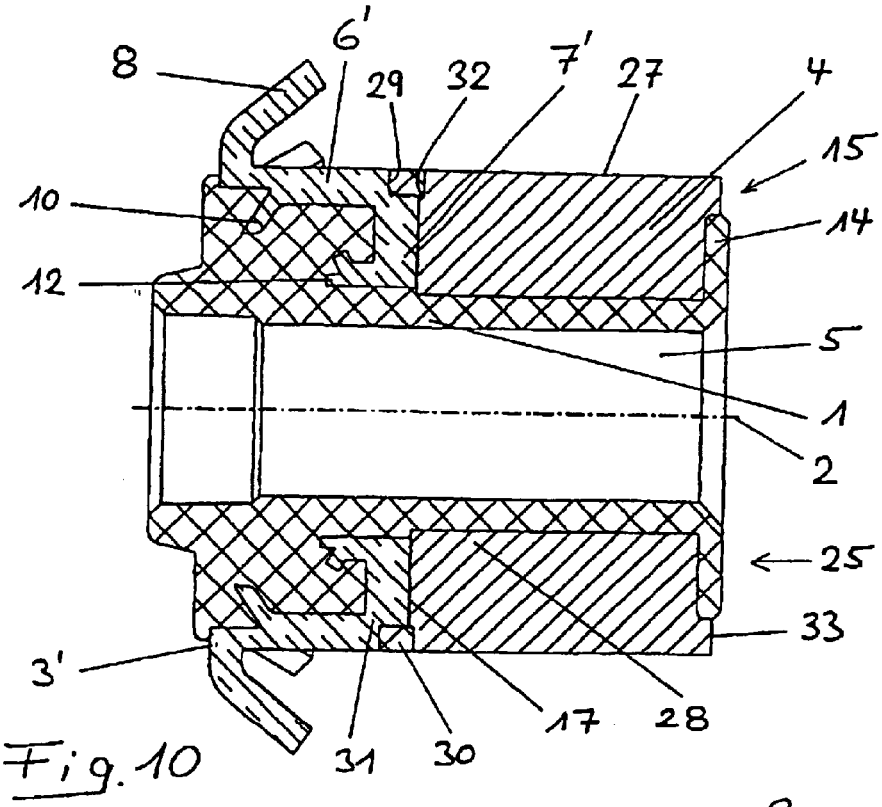
FIG. 10 shows a longitudinal section through the drum commutator according to FIG. 9.
Figure 9:
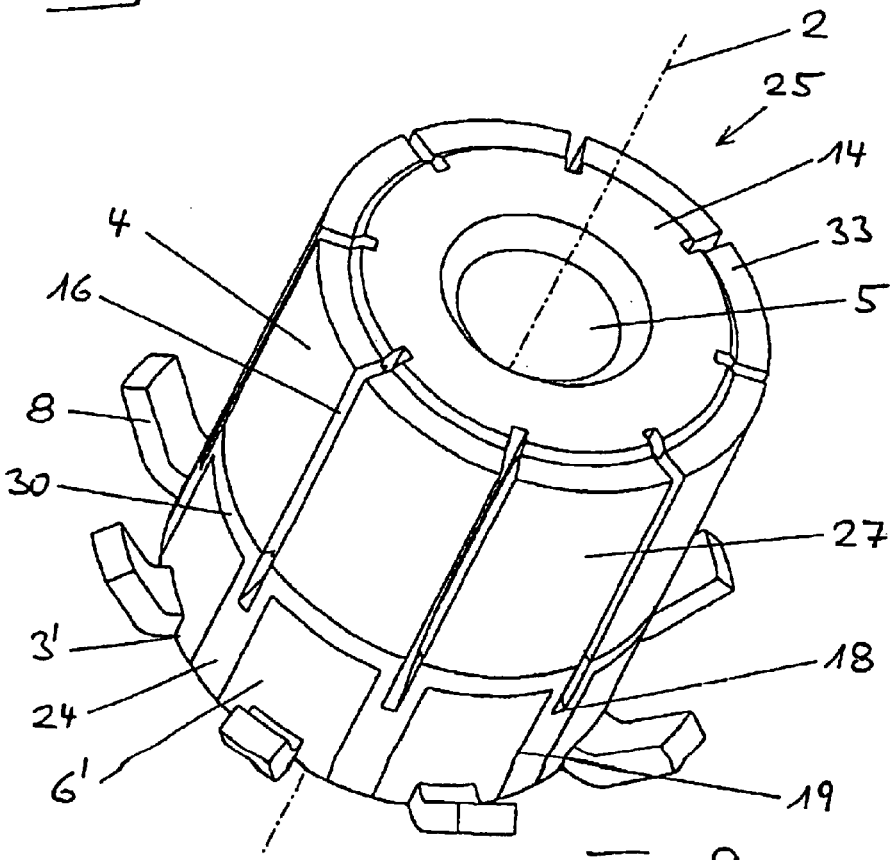
FIG. 9 shows a perspective view of a second preferred embodiment of a drum commutator according to the present invention.
Figure 11:
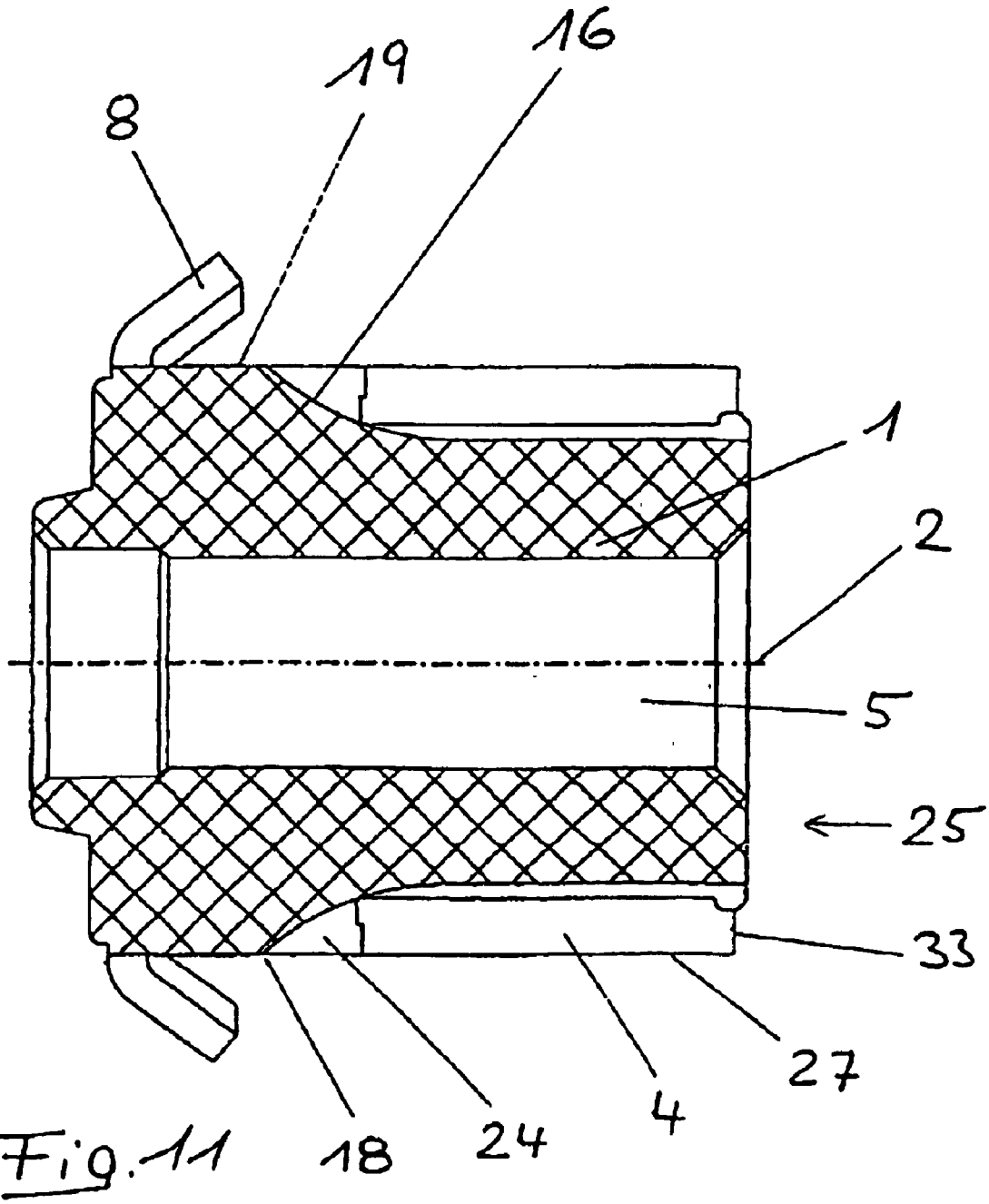
FIG. 11 shows a further longitudinal section through the drum commutator according to FIG. 9 in an axial plane different from that of FIG. 10.

The drum commutator according to FIGS. 9, 10 and 11 differs from that according to FIGS. 1 and 2 primarily by a modified structure of conductor segments 3'. These are provided on the outer circumference adjacent to contact zone 17 with a groove 29 extending in circumferential direction. This groove 29 differentiates conductor segments 3' into three main regions, namely terminal region 6', contact region 7' and transition region 31, which joins contact region 7' to terminal region 6'. In this practical example, transition region 31 is disposed obliquely relative to commutator axis 2.

In this regard, the dimensioning of conductor segments 3' in their different portions is of particular importance. Whereas the thickness—measured in radial direction—of terminal regions 6' and the thickness—measured in axial direction—of contact regions 7' are large, the cross section of transition regions 31 perpendicular to the direction of heat flow within the conductor blank is particularly small; in other words, transition regions 31 have particularly thin-walled structure, in order to form a heat resistance. Transition regions 31 are connected to contact regions 7' at a point distant from carbon segments 4, so that no contact exists between terminal regions 6' and transition regions 31 of conductor segments 3' on the one hand and carbon segments 4' on the other hand.

Before injection molding of support body 1, the originally plane end face belonging to the carbon shell and facing the conductor blank is turned on the lathe to strip the surface metallization originally present there from a radially outer annular region and thereby to form a step 32. To this extent, rib 30 of compression-molding material formed during injection molding of support body 1 extends not only into groove 29 of the conductor blank but also into the corresponding step 32 of the carbon shell. The electrically conductive joint between conductor segments 3 and carbon segments 4 is limited to the radially inner region in which anchor portions 11 of conductor segments 3 and anchor portions 28 of carbon segments 4 bear against one another.

As is also applicable for the drum commutator according to FIGS. 1 and 2, shoulder 14 of the support body covers end face 15 of the carbon segments of the drum commutator illustrated in FIGS. 9, 10 and 11 only in a radially inner region. In annular region 33 and in the region of brush contact face 27, the originally present surface metallization has been stripped off with the lathe. The injection-molding die used for injection molding of support body 1 bears sealingly against the end face of the carbon shell in annular region 33.

What is claimed is:

1. A method for producing a drum commutator comprising a barrel-shaped support body (1) made of insulating compression-molding material, a plurality of metal conductor segments (3, 3') and an equal number of carbon segments (4), which are joined to the conductor segments (3, 3') in electrically conductive relationship, comprising the following steps:

producing a metal conductor blank comprising a plurality of conductor segments, each two of which adjacent to one another are joined to one another via a bridge part (20), the distance from the radial inside faces of the bridge parts (20) to the commutator axis (2) corresponding substantially to the distance from the radial outside faces of the conductor segments (3, 3') to the commutator axis (2);

producing a carbon shell with a substantially regular cylindrical outside face (26), at least the radial inside face and one axial end face of the carbon shell being metallized;

joining the conductor blank together with the carbon shell in the axial direction to form electrically conductive contact zones (17) between the conductor segments (3, 3') and the metallized end face of the carbon shell;

injection molding of a support body (1) made of insulating compression-molding material onto the composite part comprising the conductor blank and the carbon shell in an injection-molding die, the metallized radial inside face of the carbon shell being covered with compression-molding material;

removing the bridge parts (20) with formation of an annular, closed, substantially regular cylindrical surface (19) with alternating zones of compression-molding material and metal;

forming the carbon segments (4) by incising the carbon shell with axial cuts (16) extending in radial direction as far as the support body (1) and running in axial planes disposed between each two conductor segments (3, 3'), the annular, closed, substantially regular cylindrical surface (19) with alternating zones of compression-molding material and metal being at least partly preserved.

2. A method according to claim 1, wherein the cuts (16) with which the carbon shell is divided into carbon segments (4) extend only through the carbon and compression-molding compound, but not through the metal of the conductor blank or of the conductor segments (3, 3').

3. A method according to claim 1, wherein the conductor segments (3, 3') are provided with substantially radially protruding terminal lugs (8), the bridge parts (20) extending over the entire axial length of the conductor blank being at least partly removed by being sheared off axially.

4. A method according to claim 1, wherein the electrically conductive joint between the conductor segments (3, 3') and the carbon shell is produced by soldering, the soldered joint being limited to radially inner partial regions of the end faces of the conductor segments (3').

5. A method according to claim 1, wherein the entire surface of the carbon shell is metallized, and at least the radial outside face of the carbon shell is machined to strip the metallized surface after the conductor blank has been joined together with the carbon shell, especially after the support body has been molded on by injection.

6. A method according to claim 5, wherein after the carbon shell has been joined together with the conductor blank, and in particular before the support body (1) has been molded on by injection, it is machined to strip the metallized surface in the outer annular region of both end faces.

7. A method according to claim 1, wherein after the conductor blank has been joined together with the carbon shell, and in particular before the support body has been molded on by injection, an annular slot open to the outside is machined into the carbon shell adjacent to the conductor blank.

8. A method according to claim 1, wherein the two halves of the injection-molding die used for injection molding the support body bear sealingly on two annularly closed sealing faces situated opposite one another, one being disposed on the free end face of the conductor blank and the other being disposed on the free end face of the carbon shell.

9. A drum commutator for an electrical machine, comprising a barrel-shaped support body (1) made of insulating compression-molding material, a plurality of metal conductor segments (3, 3') with terminal lugs (8) disposed thereon, and an equal number of carbon segments (4), which are joined to the conductor segments (3, 3') in electrically conductive relationship, characterized by an annular, closed, substantially regular cylindrical surface (19) disposed adjacent to the terminal lugs (8) and comprising alternating zones of compression-molding material and metal, as well as by a metallized radial inner surface that belongs to the carbon segments (4) and is joined to the support body.

10. A drum commutator according to claim 9, wherein the conductor segments (3, 3') are completely embedded in compression-molding compound in the circumferential direction, so that no metal of the conductor segments (3, 3') is exposed in the parting cuts (16) forming the air gaps that insulate the carbon segments (4) from one another.

11. A drum commutator according to claim 9, wherein the carbon segments (4) and the conductor segments (3, 3') are provided with anchor portions (28; 11) that extend radially inward, are embedded in the support body (1), and form undercuts.

12. A drum commutator according to claim 11, wherein the carbon segments and the conductor segments are joined to one another in electrically conductive relationship only in the region of the anchor portions disposed opposite one another.

13. A drum commutator according to claim 9, wherein the conductor segments (3')are each provided with a thick-walled terminal region (6')having a terminal lug (8), a thick-walled contact region (7')that contacts the associated carbon segment (4), and a thin-walled transition region (31) disposed between the terminal region (6')and the contact region (7').

14. A drum commutator according to claim 13, wherein the transition regions are oriented substantially radially relative to the commutator axis (2).

15. A drum commutator according to claim 13, wherein the transition regions (31) are oriented obliquely relative to the commutator axis (2).

16. A drum commutator according to claim 13, wherein respective ribs (30) of compression-molding material are disposed between the terminal regions (6')of the conductor segments (3')on the one hand and the carbon segments (4) on the other.

17. A drum commutator according to claim 16, wherein the axial thickness of the rib (30) of compression-molding material is at least 0.5 mm.

18. A drum commutator according to claim 13, wherein the end faces belonging to the conductor segments (3, 3') and the carbon segments (4) and facing one another in the region of the contact zones (17) are plane.

19. A drum commutator according to claim 9, wherein the end faces (25) belonging to the carbon segments and facing away from the conductor segments (3, 3') are covered only in a radially inner region by a shoulder (14) of the support body (1).

20. A drum commutator according to claim 19, wherein the shoulder (14) of the support body (1) projects in the axial direction beyond the end face of the carbon segments (4).

* * * * *